US011325769B2

(12) United States Patent
Kim et al.

(10) Patent No.: US 11,325,769 B2
(45) Date of Patent: May 10, 2022

(54) CUSHIONING PACKAGING MATERIAL

(71) Applicant: SAMSUNG ELECTRONICS CO., LTD., Suwon-si (KR)

(72) Inventors: Byung Chan Kim, Yongin-si (KR); Il Song Park, Seoul (KR); Jeong Eun Shin, Suwon-si (KR); Min-Gyu Jung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 283 days.

(21) Appl. No.: 16/345,493

(22) PCT Filed: Sep. 26, 2017

(86) PCT No.: PCT/KR2017/010603

§ 371 (c)(1),
(2) Date: Apr. 26, 2019

(87) PCT Pub. No.: WO2018/080035

PCT Pub. Date: May 3, 2018

(65) Prior Publication Data

US 2019/0308790 A1 Oct. 10, 2019

(30) Foreign Application Priority Data

Oct. 27, 2016 (KR) ..... 10-2016-0141235

(51) Int. Cl.
*B65D 81/03* (2006.01)
*B65D 25/10* (2006.01)
*B65D 81/05* (2006.01)

(52) U.S. Cl.
CPC ..... *B65D 81/03* (2013.01); *B65D 25/10* (2013.01); *B65D 81/052* (2013.01); *B65D 2581/051* (2013.01); *B65D 2585/6847* (2013.01)

(58) Field of Classification Search
CPC ..... B65D 81/052; B65D 81/03; B65D 81/05; B65D 81/051; B65D 25/10
(Continued)

(56) References Cited

U.S. PATENT DOCUMENTS 5,624,035 A 4/1997 Kim
6,468,239 B1 * 10/2002 Mollura, Sr ..... A61F 5/0111 128/882

(Continued)

FOREIGN PATENT DOCUMENTS

JP 2003-292047 A 10/2003
JP 2005-1758 A 1/2005

(Continued)

OTHER PUBLICATIONS

International Search Report dated Dec. 22, 2017 from International Patent Application No. PCT/KR2017/010603, 5 pages.

(Continued)

*Primary Examiner* — Ernesto A Grano
(74) *Attorney, Agent, or Firm* — Staas & Halsey LLP

(57) ABSTRACT

A cushioning packaging material for packaging one or more electronic products and the like is disclosed. The cushioning packaging material includes a cushioning portion provided with a plurality of air pockets, an air distribution portion provided with a distribution passage through which air is distributed into the plurality of air pockets, and an air inlet provided at one side of the air distribution portion. The air inlet is closed after completion of air injection. Thus, air leakage through the air inlet is prevented and cushioning force reduction caused by air leakage is also prevented.

6 Claims, 6 Drawing Sheets

(58) Field of Classification Search
USPC ..... 206/522
See application file for complete search history.

(56) References Cited

U.S. PATENT DOCUMENTS

| | | | | |
|---|---|---|---|---|
| 8,251,216 | B1 | 8/2012 | Liao | |
| 8,714,356 | B2 * | 5/2014 | Liao | B65D 81/052 206/522 |
| 9,623,622 | B2 * | 4/2017 | Baines | B31D 5/0073 |
| 2007/0051655 | A1 * | 3/2007 | Yoshifusa | B65D 81/075 206/522 |
| 2007/0084745 | A1 * | 4/2007 | Yoshifusa | B65D 81/052 206/522 |
| 2007/0170084 | A1 * | 7/2007 | Chen | B65D 81/052 206/522 |
| 2009/0050509 | A1 * | 2/2009 | Liao | B65D 81/052 206/522 |
| 2010/0072103 | A1 * | 3/2010 | Watanabe | B65D 81/052 206/522 |
| 2010/0101970 | A1 * | 4/2010 | Frayne | B31D 5/0073 206/522 |
| 2011/0233101 | A1 * | 9/2011 | Baines | B31D 5/0073 206/522 |
| 2013/0292289 | A1 * | 11/2013 | Zhang | F16K 15/202 206/522 |
| 2013/0313152 | A1 * | 11/2013 | Liao | B65D 81/052 206/522 |
| 2020/0129801 | A1 * | 4/2020 | Pace | A63B 21/072 |

FOREIGN PATENT DOCUMENTS

| | | | |
|---|---|---|---|
| JP | 2009-137587 | A | 6/2009 |
| KR | 10-2008-0086990 | A | 9/2008 |

OTHER PUBLICATIONS

Written Opinion of International Searching Authority dated Dec. 22, 2017 from International Patent Application No. PCT/KR2017/010603, 6 pages.

* cited by examiner

FIG.,1

CUSHIONING PACKAGING MATERIAL

CROSS-REFERENCE TO RELATED APPLICATIONS

This application is a U.S. National Stage Application which claims the benefit under 35 U.S.C. § 371 of International Patent Application No. PCT/KR2017/010603 filed on Sep. 26, 2017, which claims foreign priority benefit under 35 U.S.C. § 119 of Korean Patent Application No. 10-2016-0141235 filed Oct. 27, 2016, the entire contents of both of which are incorporated herein by reference.

TECHNICAL FIELD

Embodiments of the present disclosure relate to a cushioning packaging material for packaging an electronic product.

BACKGROUND ART

Generally, a cushioning packaging material includes an object (or a product) so that the object can be protected from external impact.

In recent times, various kinds of cushioning packaging materials have been developed and widely used. Specifically, a representative example of such cushioning packaging materials is an air injection-type cushioning packaging material having a plurality of air pockets into which air is injected such that external impact can be prevented from being transferred to at least one object to be packed through the air pockets.

DISCLOSURE

Technical Problem

It is an object of the present disclosure to provide a cushioning packaging material having a plurality of air pockets into which air is injected, such that the cushioning packaging material can prevent air from leaking outside through the air pockets even when used for a long time.

Technical Solutions

The objects of the present disclosure can be achieved by a cushioning packaging material including a cushioning portion provided with a plurality of air pockets, an air distribution portion provided with a distribution passage through which air is distributed into the plurality of air pockets, and an air inlet provided at one side of the air distribution portion. The air inlet may be closed after completion of air injection.

The air inlet may be fused by heat and pressure such that the air inlet is closed.

The cushioning packaging material may further include a plurality of valves configured to couple the plurality of air pockets to the distribution passage so as to prevent back flow of air.

The plurality of air pockets may extend parallel to each other in a first direction. The distribution passage may extend in a second direction perpendicular to the first direction, such that the distribution passage is coupled to one end of the plurality of air pockets.

A section of the cushioning portion may be folded, and both ends of the folded section may be fused to both ends of another section neighboring the folded section, resulting in formation of a storage space.

The cushioning packaging material may further include a strap, both ends of which are respectively attached to separation parts of the cushioning portion.

The strap may include two attachment portions having adhesive force such that the two attachment portions are respectively provided at both ends of the strap.

In accordance with another aspect of the present disclosure, a cushioning packaging material may include a cushioning portion provided with a plurality of air pockets. A section of the cushioning portion is folded, and both ends of the folded section are fused to both ends of another section neighboring the folded section, resulting in formation of a storage space.

In accordance with another aspect of the present disclosure, a cushioning packaging material includes a cushioning portion provided with a plurality of air pockets, and a strap. Both ends of the strap may be respectively attached to separation parts of the cushioning portion such that the cushioning portion remains deformed in shape.

Advantageous Effects

As is apparent from the above description, the cushioning packaging material according to the embodiment of the present disclosure may allow an air inlet to be closed after completion of air injection, such that air leakage through the air inlet is prevented and cushioning force reduction caused by such air leakage is also prevented.

The cushioning packaging material according to the embodiment of the present disclosure may form a storage space.

The cushioning packaging material according to the embodiment of the present disclosure may remain unchanged in a state in which the cushioning packaging material is deformed through a strap.

BEST MODE

Figure 1:
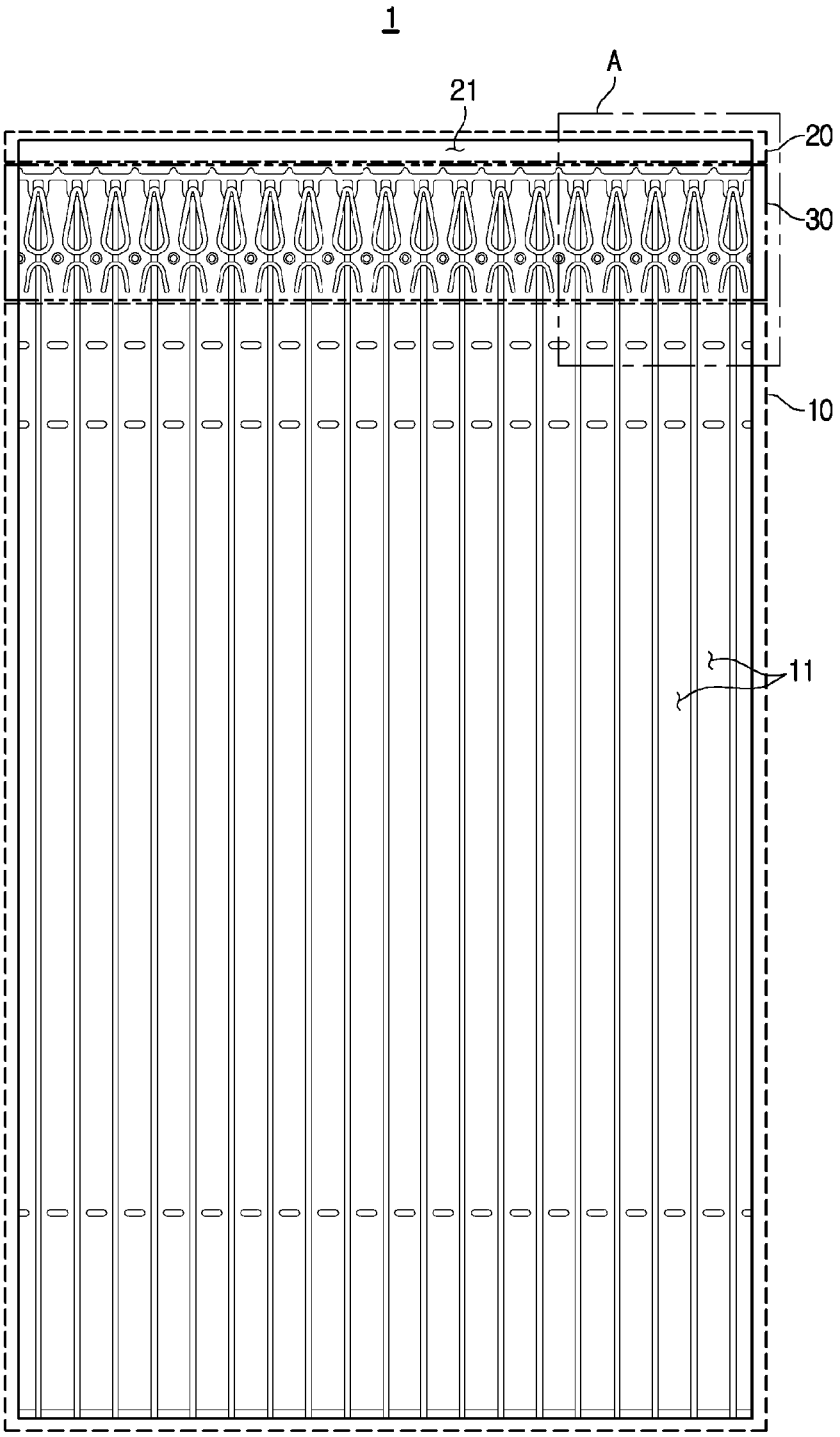
FIG. 1 is an exploded view illustrating a cushioning packaging material according to an embodiment of the present disclosure.

Reference will now be made in detail to the embodiments of the present disclosure, examples of which are illustrated in the accompanying drawings, wherein like reference numerals refer to like elements throughout.

In addition, the same reference numbers or symbols disclosed in the drawings of the present disclosure may represent parts or components which perform substantially the same function.

The terms used in the present application are merely used to describe specific embodiments and are not intended to limit the present disclosure. A singular expression may include a plural expression unless otherwise stated in the context. In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present disclosure, the terms "first" and "second" may be used to describe various components, but the components are not limited by the terms. The terms may be used to distinguish one component from another component. For example, a first component may be called a second component and a second component may be called a first component without departing from the scope of the present disclosure. The term "and/or" may include a combination of a plurality of items or any one of a plurality of items.

Terms "front end", "rear end", "upper part," "lower part," "upper end," and "lower end" are defined based on the drawings and do not limit shapes and positions of constituent components.

A cushioning packaging material according to an embodiment of the present disclosure will hereinafter be described with reference to the attached drawings.

Figure 2:
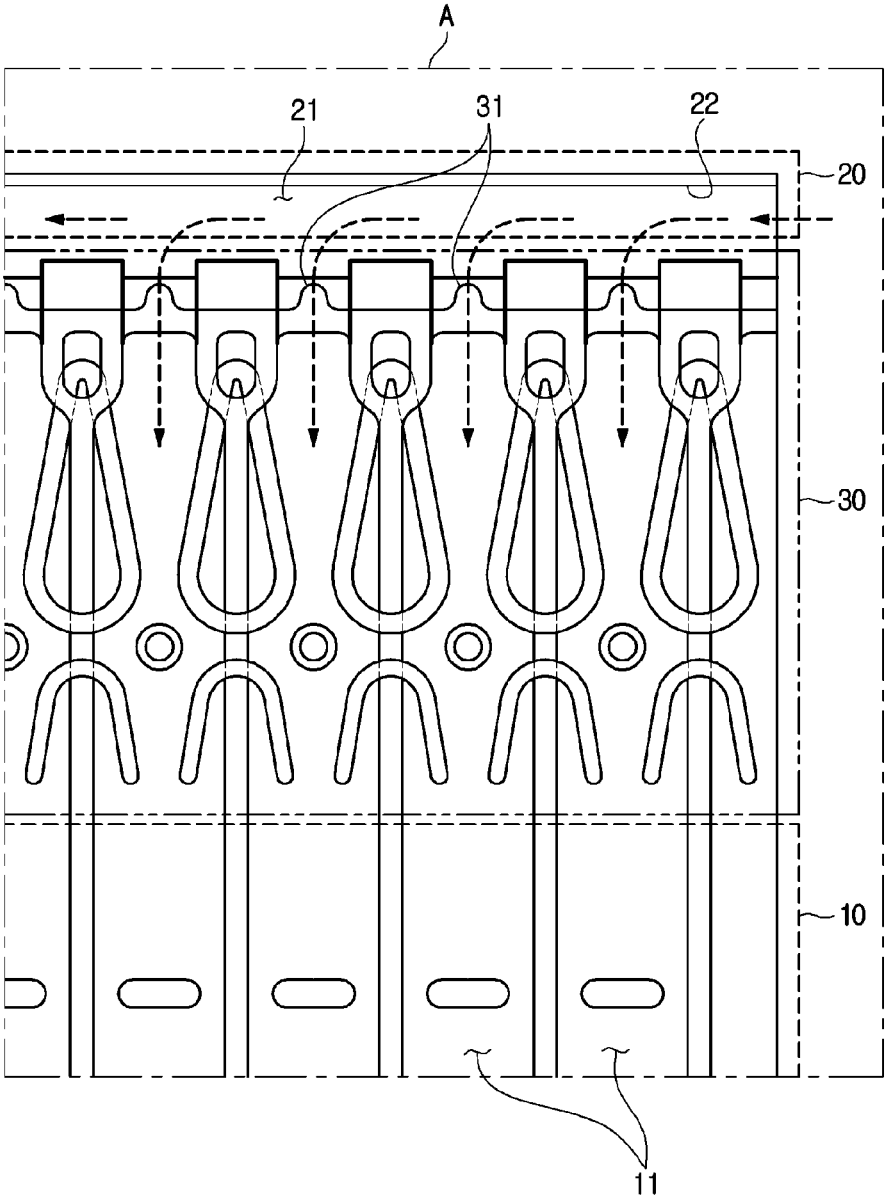
FIG. 2 is an enlarged view illustrating a part "A" of FIG. 1.

Referring to FIGS. 1 and 2, a cushioning packaging material 1 according to the present embodiment may include a cushioning portion 10, an air distribution portion 20, and a valve portion 30. The cushioning portion 10 may be formed by fusing two films to each other, and may include a plurality of air pockets 11, thereby absorbing external impact. The air distribution portion 20 may include an air distribution passage 21 through which air is distributed into the air pockets 11. The valve portion 30 may be provided between the air distribution portion 20 and the cushioning portion 10 so as to control flow of air.

The plurality of air pockets 11 may extend in a first direction, and may be arranged parallel to each other in a second direction perpendicular to the first direction.

The air distribution portion 20 may include a single distribution passage 21 extending in a direction perpendicular to the first direction. The distribution passage 21 may be coupled to one end of the plurality of air pockets 11.

An air inlet 22 may be provided at one side of the air distribution portion 20. Therefore, an air injection device (not shown) may inject air into the distribution passage 21 through the air inlet 22.

The valve portion 30 may include a plurality of valves 31 provided between the distribution passage 21 and the air pockets 11. The valves 31 may couple the distribution passage 21 to the air pockets 11, may enable air to be injected from the distribution passage 21 into the air pockets 11, and may prevent the air injected into the air pockets 11 from flowing backward to the distribution passage 21.

Therefore, when air is injected through the air inlet 22 by the air injection device, the air is evenly distributed into the plurality of air pockets 11 through the distribution passage 21, thereby expanding the air pockets 11. Since the valves 31 prevent backflow of air as described above, the air injected into the air pockets 11 may remain unchanged in the air pockets 11. The air filling the air pockets 11 is considered a compressible fluid, such that the air pockets 11 may have cushioning force.

However, although the valves 31 operate to prevent backflow of air as described above, the air has gaseous characteristics such that there is a high possibility that a small amount of air flows backward to the distribution passage 21 through the valves 31 and is unavoidably discharged outside through the air inlet 22. If such backflow and leakage of air continuously occur for a long time, cushioning force of the cushioning portion 10 may be reduced.

Figure 3:
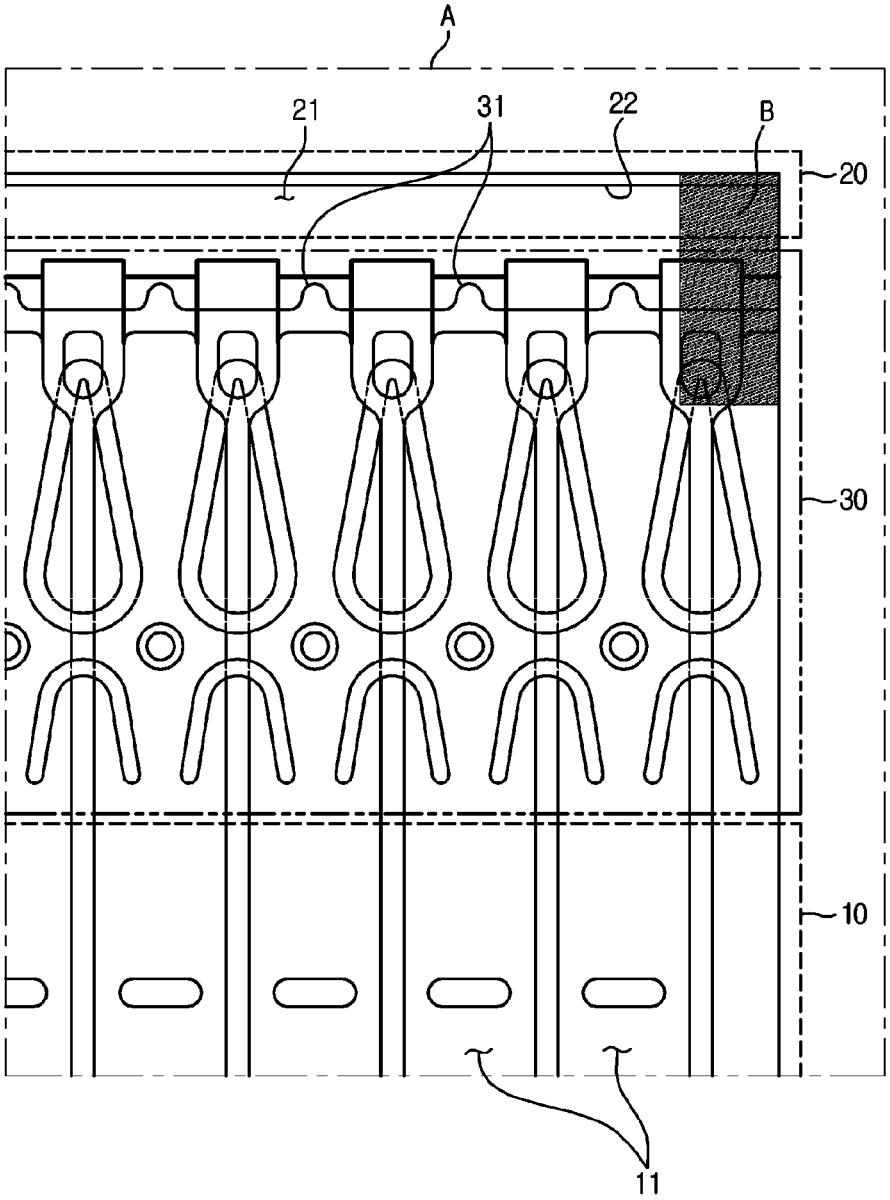
FIG. 3 is an enlarged view illustrating the part "A" of FIG. 1, and illustrates a closed air inlet of the cushioning packaging material.

Therefore, the air inlet 22 of the cushioning packaging material 1 according to the present embodiment may be closed through fusion. FIG. 3 illustrates a fusion part "B" in which fusion for closing the air inlet 22 is achieved. That is, when heat and pressure are applied to the fusion part "B" of FIG. 3, some parts of two films forming the cushioning packaging material 1 are fused to each other, such that the air inlet 22 is closed.

As described above, when the air inlet 22 is closed, inner pressure of the distribution passage 21 is maintained at the same pressure level as the air pockets 11, it is difficult for air filling the air pockets 11 to flow backward through the valves 31. Therefore, even when the cushioning packaging material is used for a long time, cushioning force of the air pockets 11 provided in the cushioning portion 10 may remain unchanged.

Although the air inlet 22 according to the present embodiment is closed through fusion for convenience of description, the scope or spirit of the present disclosure is not limited thereto, and it should be noted that the air inlet 22 can also be closed in various ways as necessary.

Figure 4:
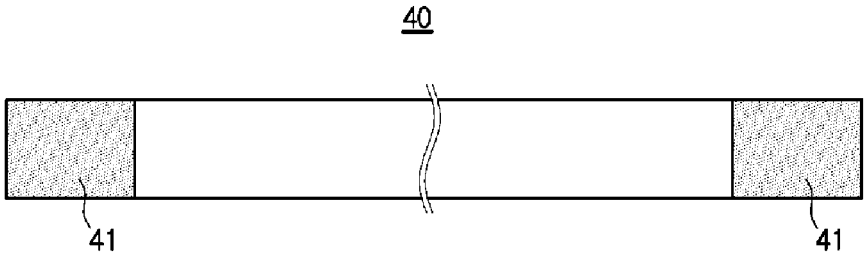
FIG. 4 is an exploded perspective view illustrating a state in which an electronic product is packaged by a cushioning packaging material according to an embodiment of the present disclosure.

In addition, as shown in FIG. 4, the cushioning packaging material 1 may include a strap 40 by which a deformed state of the cushioning packaging material 1 modified in shape can be maintained unchanged. The strap 40 may extend to have at least a predetermined length. Attachment portions 41 having adhesive force may be provided at both ends of the strap 40.

Therefore, after the cushioning packaging material 1 is folded and deformed to form a predetermined shape, the attachment portions 41 of the strap 40 are attached to the folded cushioning packaging material 1, such that the cushioning packaging material 1 can remain folded in the predetermined shape.

Figure 5:
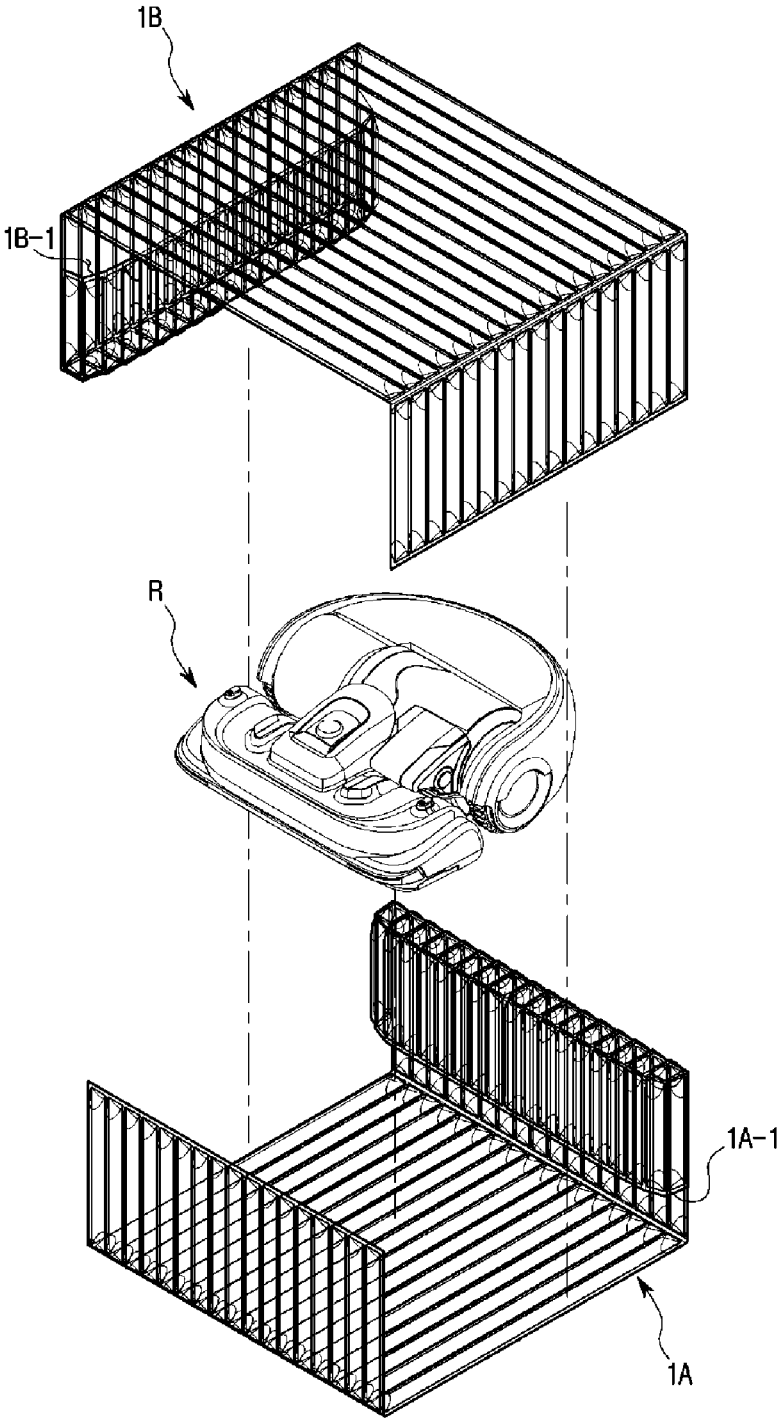
FIG. 5 is a schematic view illustrating a strap applied to the cushioning packaging material according to an embodiment of the present disclosure.

In addition, as shown in FIG. 5, in each of cushioning packaging materials 1A and 1B according to the present embodiment, a section of one end of the cushioning portion 10 may be folded, and both ends of the folded section are fused to both ends of another section neighboring the folded section, resulting in formation of storage spaces 1A-1 and 1B-1.

If the storage spaces 1A-1 and 1B-1 are formed through the cushioning packaging material 1 as described above, accessories, for example, an adapter or a user manual of an electronic product, can be stored in the storage spaces 1A-1 and 1B-1, such that the cushioning packaging material 1 serves as a packaging material and also serves to provide a necessary storage space of an object or product.

Figure 6:
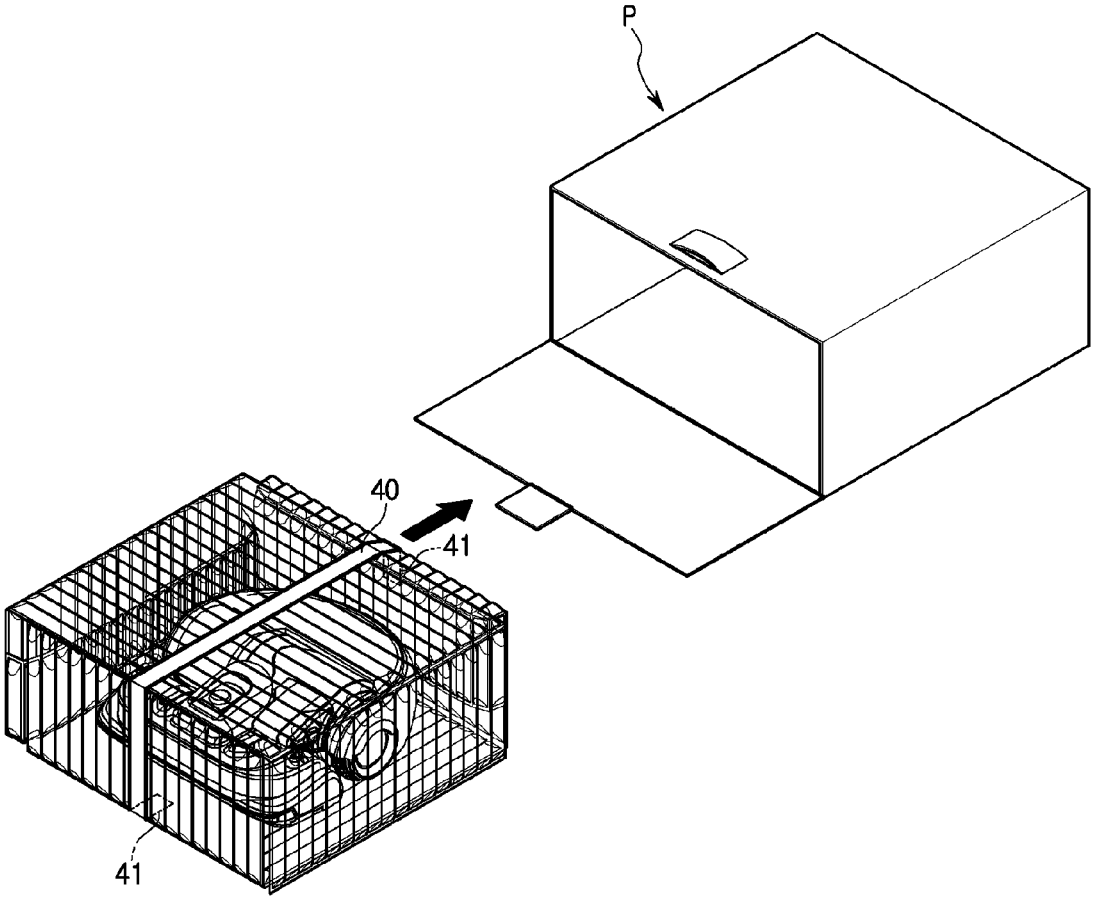
FIG. 6 is a perspective view illustrating an installation state of a strap applied to the cushioning packaging material according to an embodiment of the present disclosure.

An exemplary case of packaging a robot cleaner R from among electronic products using the above-mentioned cushioning packaging material will hereinafter be described with reference to FIGS. 5 and 6.

In the present embodiment, two cushioning packaging materials 1A and 1B and a single strap 40 are used to pack the robot cleaner R.

As can be seen from FIG. 5, a lower one of the two cushioning packaging materials 1A and 1B will hereinafter be referred to as a first cushioning packaging material 1A, and an upper one of the two cushioning packaging materials 1A and 1B will hereinafter be referred to as a second cushioning packaging material 1B.

The first cushioning packaging material 1A may include a first storage space 1A-1 provided at one side thereof such that an adapter (not shown) and a charging dock (not shown) can be provided in the first storage space 1A-1. The first cushioning packaging material 1A may be folded in an approximately U-shape, such that the robot cleaner R can be stored in the first cushioning packaging material 1A formed in the approximately U-shape.

The second cushioning packaging material 1B may include a second storage space 1B-1 provided at one side thereof such that a user manual (not shown) and the like can be stored in the second storage space 1B-1. The second cushioning packaging material 1B may be folded in an approximately reverse-U shape (i.e., ∩ shape).

The second cushioning packaging material 1B having been rotated by about 90 degrees with respect to the first cushioning packaging material 1A may be installed above the first cushioning packaging material 1A, such that an opened upper side and both opened lateral sides of the first U-shaped cushioning packaging material 1A can be covered by the second ∩-shaped cushioning packaging material 1B.

Therefore, the robot cleaner R may be completely covered by the first cushioning packaging material 1A and the second cushioning packaging material 1B.

Under the above situation, the strap 40 may be attached to the first cushioning packaging material 1A. The attachment portions 41 provided at both ends of the strap 40 may be respectively attached to both sides of the first U-shaped cushioning packaging material 1A, thereby supporting a top surface of the second cushioning packaging material 1B.

Therefore, the first cushioning packaging material 1A may remain bent in the U-shape by the strap 40, and the second cushioning packaging material 1B may be maintained to cover the upper side of the first cushioning packaging material 1A.

One attachment portion 41 provided at a front end of the strap 40 may be attached to a bottom surface of the first cushioning packaging material 1A. Therefore, the strap 40 may pass through a front surface of the first cushioning packaging material 1A and a top surface of the second cushioning packaging material 1B, and the other attachment portion 41 provided at a rear end of the strap 40 may be attached to a rear surface of the first cushioning packaging material.

Thus, a part of the strap 40 disposed to face the front surface of the first cushioning packaging material 1A may be used as a handle through which the user can easily draw or take out the robot cleaner R packaged with the cushioning packaging materials 1A and 1B from a box (P) including the robot cleaner R.

Although the present embodiment has disclosed only one strap 40 used for packaging the robot cleaner R for convenience of description, the scope or spirit of the present disclosure is not limited thereto, and it should be noted that at least two straps 40 may also be used for such packaging to more stably package the electronic product as necessary.

In addition, although the present embodiment has disclosed the strap 40 in which two attachment portions 41 having adhesive force are respectively provided at both ends for convenience of description, the scope or spirit of the present disclosure is not limited thereto, and it should be noted that the attachment portions may be formed only at one end of the strap 40 and the other end of the strap 40 may be integrated with the cushioning packaging material as necessary.

Although the embodiments of the present disclosure have been disclosed for illustrative purposes, those skilled in the art will appreciate that various modifications, additions and substitutions are possible, without departing from the scope and spirit of the invention as disclosed in the accompanying claims.

The invention claimed is:

1. A cushioning packaging material comprising:

a first cushioning packaging material having a U-shape;

a second cushioning packaging material disposed above the first cushioning packaging material such that an opened upper side and both opened lateral sides of the first cushioning packaging material can be covered by the second cushioning packaging material; and a strap surrounding both side surfaces and a bottom surface of the first cushioning packaging material and a top surface of the second cushioning packaging material while the opened upper side and both opened lateral sides of the first cushioning packaging material are covered by the second cushioning packaging material, each of the first cushioning packaging material and the second cushioning packaging material comprising;

a cushioning portion provided with a plurality of air pockets;

an accommodating pocket formed by deforming a portion of the cushioning portion provided at one end portion in a longitudinal direction of the cushioning portion and including a storage space to accommodate an object;

an air distribution portion provided with a distribution passage through which air is distributed into the plurality of air pockets; and an air inlet provided at one side of the air distribution portion, wherein the air inlet is closed after completion of air injection, and wherein the cushioning portion includes:

two vertical sides facing each other;

a lateral side connecting between the two vertical sides, and an accommodating space formed on an inside of the two vertical sides and the lateral side, and wherein the accommodating pocket is provided at one of the two vertical sides and disposed within the accommodating space, and the storage space is partitioned from the accommodating space.

2. The cushioning packaging material according to claim 1, wherein the air inlet is fused by heat and pressure such that the air inlet is closed.

3. The cushioning packaging material according to claim 1, wherein each of the first cushioning packaging material and the second cushioning packaging material further comprises:

a plurality of valves configured to couple the plurality of air pockets to the distribution passage so as to prevent back flow of air.

4. The cushioning packaging material according to claim 1, wherein:

the plurality of air pockets extends parallel to each other in a first direction; and the distribution passage extends in a second direction perpendicular to the first direction, such that the distribution passage is coupled to one end of the plurality of air pockets.

5. The cushioning packaging material according to claim 1, wherein:

the accommodating pocket further includes a folded portion folded to face with an unfolded portion of the cushioning portion, and a fused portion formed by fusion of both sides of the folded portion and both sides of the unfolded portion.

6. The cushioning packaging material according to claim 1, wherein the strap includes two attachment portions having adhesive force such that the two attachment portions are respectively provided at both ends of the strap.

* * * * *